United States Patent [19]

Butherus et al.

[11] 3,953,251

[45] Apr. 27, 1976

[54] METHOD FOR THE PRODUCTION OF CARBONYL IRON CONTAINING MAGNETIC DEVICES WITH SELECTED TEMPERATURE VARIATION

[75] Inventors: Alexander Duane Butherus, Murray Hill; Milton Everett Terry, Mountainside, both of N.J.

[73] Assignee: Bell Telephone Laboratories, Incorporated, Murray Hill, N.J.

[22] Filed: Mar. 25, 1974

[21] Appl. No.: 454,152

[52] U.S. Cl. ..... 148/105; 148/31.55; 148/103; 148/108

[51] Int. Cl.[2] ..... H01F 1/02

[58] Field of Search ..... 148/105, 31.55, 103, 148/104, 108; 335/209; 264/DIG. 58

[56] References Cited

UNITED STATES PATENTS

| | | | |
|---|---|---|---|
| 1,733,592 | 10/1929 | Given | 148/105 |
| 2,158,132 | 5/1939 | Legg | 148/31.55 |
| 2,783,208 | 2/1957 | Katz | 148/105 |
| 2,971,872 | 2/1961 | Dunton et al. | 148/105 |
| 2,999,275 | 9/1961 | Blume | 264/DIG. 58 |
| 3,120,698 | 2/1964 | Elliott | 148/105 |
| 3,348,982 | 10/1967 | Dunton | 148/31.55 |
| 3,498,918 | 3/1970 | Copp | 148/104 |
| 3,502,584 | 3/1970 | Denes | 148/31.55 |

*Primary Examiner*—Walter R. Satterfield
*Attorney, Agent, or Firm*—A. N. Friedman

[57] ABSTRACT

Carbonyl iron powder core (dust core) materials whose rate of change of magnetic permeability with temperature are preselected, are produced by a process which includes the mixing together of powders from two source batches. These source batches produce core materials whose temperature coefficients, $Y$ and $Z$, lie on either side of the desired temperature coefficient, $X$. The fraction, $A$, of the $Y$ powder is selected in accordance with the formula:

$$A = 0.7\,[(X-Y)/(Z-Y)] + 0.15;\ 0.15 \leq A \leq 0.85.$$

Exemplary core materials incorporate a phosphate insulator and a phenolic binder.

8 Claims, 3 Drawing Figures

METHOD FOR THE PRODUCTION OF CARBONYL IRON CONTAINING MAGNETIC DEVICES WITH SELECTED TEMPERATURE VARIATION

BACKGROUND OF THE INVENTION

1. Field of the Invention

The invention is in the field of magnetic materials for use at transmission carrier frequencies.

2. Brief Description of the Prior Art

The temperature variation of the magnetic permeability of materials used in communication systems has been of continuing concern to the designer of devices such as frequency selection filters. If metallic magnetic materials are to be used at high frequencies, some method of reducing eddy current losses is usually required. One widely used class of materials consists of fine particles of the magnetic material which are coated with an insulating material and compressed to form the desired magnetic body. Two common materials used in this fashion are carbonyl iron powders and pulverized permalloy powders. In order to control the temperature variation of the magnetic properties of powder cores, trial and error mixture of powders exhibiting different temperature variation has been used. For example, permalloy of different alloy compositions have been incorporated in temperature compensated powder cores (*Metal Progress*, 54 (1948) Page 710–711). The objective there, was to minimize the temperature variation of the permeability of the magnetic body over the temperature range of interest. The usual procedure has been to form a series of test bodies incorporating the constituent powders in various proportions until the mixture producing the desired properties is found.

SUMMARY OF THE INVENTION

A procedure has been developed to predetermine the approximately linear temperature variation of magnetic permeability of carbonyl iron containing, powder bodies. In this process the various available batches of carbonyl iron powder are prepared for pressing by the application of insulating material and binder (with, perhaps, a lubricant). Test bodies are prepared from each of the batches and the temperature coefficient of magnetic permeability of each of the test bodies is measured. Two batches are selected corresponding to test bodies possessing a higher and a lower temperature coefficient than that desired. In order to produce a material of the desired temperature variation, powders from the selected source batches are mixed in a proportion selected in accordance with the formula:

$$A = 0.7\,[(X-Y)/(Z-Y)] + 0.15;\ 0.15 \leq A \leq 0.85. \qquad \text{(Eq 1)}$$

In this formula $X$ is the desired temperature coefficient, $Y$ and $Z$ are the temperature coefficients of the selected source batches and $A$ is the fraction by weight of source batch $Y$.

DETAILED DESCRIPTION OF THE INVENTION

Carbonyl Iron Powder Materials

Figure 2:
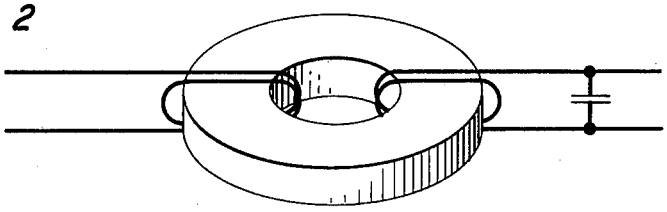
FIG. 2 is a partially perspective partially schematic view of a transformer-coupled resonant circuit incorporating a magnetic core produced by the disclosed process.

Iron powders, whose grain size is typically in the range from 1 to 10 micrometers, are produced by the thermal decomposition of iron pentacarbonyl, $Fe(CO)_5$. These powders have been used for many years in the production of inductor and transformer cores and tuning slugs. Such cores are used at frequencies, typically from 10 khz to 100 Mhz, commonly used as carriers in communication systems. At these frequencies it is difficult to reduce eddy current losses in metallic magnetic cores by such methods as lamination of thin sheets. One feature of these cores which makes them useful for resonant filter circuits is the nearly linear variation of magnetic permeability with temperature over a wide temperature range centered around room temperature. Cores whose coefficient of magnetic permeability vary by less than ± 15 parts per million over a temperature range from −40°C to +80°C have been produced. These can be combined with devices such as capacitors possessing compensating temperature variation to produce, for example, resonant filter circuits (See FIG. 2) with sufficiently constant resonant frequency over this range.

In order to fabricate magnetic bodies with small eddy current losses at the frequency of interest, the powder grains are coated with an insulating material to prevent metallic contact between grains. Before being pressed or otherwise formed into a solid of the desired shape, the insulated powders are coated with a binder such as a thermoplastic or thermosetting resin or mixture of resins. The amount of insulation and binder required are selected in accordance with the extensive art developed in this field. In selecting these quantities the material designer considers such parameters of the frequency of intended use, the allowable loss (the required circuit Q) and the required magnetic permeability. A lubricant is often added to facilitate fabrication.

An exemplary method for the formation of an insulating coating on the carbonyl iron grains is the treatment of the powder with a solution of phosphoric acid in an organic solvent such as acetone. This treatment provides each grain with a coating which is essentially iron phosphate. In order to provide sufficiently low loss for most circuit uses, as insulating coating amounting to at least 0.05 percent by weight must be provided at the lower end of the frequency range of interest. Use at higher frequencies generally requires more insulation to produce the same loss value. At least 1 weight percent insulation should be used in the 1Mhz to 10 Mhz range. A maximum of 10 weight percent is recommended in this frequency range. Increasing the amount of insulation to more than 25 percent of the weight of the final material is ineffective in further reducing metallic contact and only serves to make the body more magnetically dilute.

The insulated powder grains can be coated with a binder by mixing them with a solution of the prepolymer of the binder resin (together with any required hardener) in an organic solvent and drying the resultant slurry. The dried slurry typically forms a cake which is ground into particles of size desirable for further processing. In order to form a final magnetic body with sufficient strength to withstand normal handling, at least one percent by weight of binder should be included in the particles. Two percent is to be preferred for added strength. Increasing the amount of binder to more than 25 percent of the weight of the final material is ineffective in further increasing the material strength and only serves to make the body more magnetically dilute.

During powder preparation a lubricant, such as an olefin wax, can be incorporated to facilitate the formation of the desired magnetic body. In some fabrication methods, such as pressing, the lubricant serves both to help reduce void space and aid in the release of the pressed body from the mold. For such use, at least 0.1 percent by weight of lubricant should be included. A preferred class of lubricants are waxes whose melting point is at least 100°C. Waxes of this class are hard enough to be powdered for incorporation into the magnetic powder by simple powder mixing. The inclusion of more than 5 percent by weight of lubricant based on the total weight of the other constituents could deleteriously affect the mechanical properties of the resulting body.

The insulated and bindered powders, with or without lubricant, should contain at least 50 percent by weight of carbonyl iron powder. If the carbonyl iron content is less than this value, the effective permeability of the resulting magnetic body will be undesirably low for most circuit uses.

The insulated and bindered powders thus produced, are ready for fabrication into magnetic bodies of the desired shape, such as tuning slugs, toroidal cores or cup cores. Such fabrication is accomplished by such methods as applying uniaxial pressures in the range 10 to 100 tons per square inch to a quantity of the powder contained in a die, by hot molding, by injection molding or by extruding. The selection of processing conditions will take into account such factors as a desire to minimize the void space in the resulting body as opposed to the desire to minimize deformation of the grains and the piercing of the insulation between the grains. When the binder is a thermosetting resin, after the formation of the solid, a heat treatment is usually required to set the binder and develop the desired mechanical properties of the finished product.

Variation of Magnetic Permeability with Temperature

It was found that different batches of carbonyl iron powder, when processed into inductor or transformer cores (See FIG. 2), produced cores exhibiting an approximately linear variation of magnetic permeability with temperature which differs from batch to batch by an amount which, although acceptable for many uses, is too great for the most demanding resonant filter uses. The greatest batch to batch variation was found to be between carbonyl iron powders obtained from different suppliers. This may reflect some differences in the manufacturing conditions used in the production of the carbonyl iron powders.

During these developments and those referred to below it was found satisfactory to linearize the approximately linear temperature variation. This was done by selecting two test temperatures and treating the observed temperature variation as being identically linear through these two points over the entire temperature range of interest. The slope of a straight line connecting these two test points on a curve of magnetic permeability vs temperature (where both ordinate and abscissa are plotted linearly) is referred to herein as the "temperature coefficient" of the material. As the test temperatures are selected closer to one another, the temperature coefficient thus defined becomes the slope of the tangent to the curve describing the approximately linear temperature variation. As far as has been determined, these curves for different source batches form a family of curves such that their slopes at any temperature within the range of interest, define temperature coefficients which behave in the manner presented below.

The method developed for predetermining the temperature coefficient of magnetic permeability of these materials involves the mixing of powders from two batches. In this method two source batches are selected, each of which produce cores whose temperature coefficients bracket the desired temperature coefficient (one being too high and the other too low). It was found that magnetic bodies possessing the desired temperature coefficient could be produced by mixing powders from these two batches in a proportion selected in accordance with the formula:

$$A = 0.7\,[(X-Y)/(Z-Y)]+0.15;\ 0.15 \leq A \leq 0.85. \qquad \text{Eq 1)}$$

Figure 1:
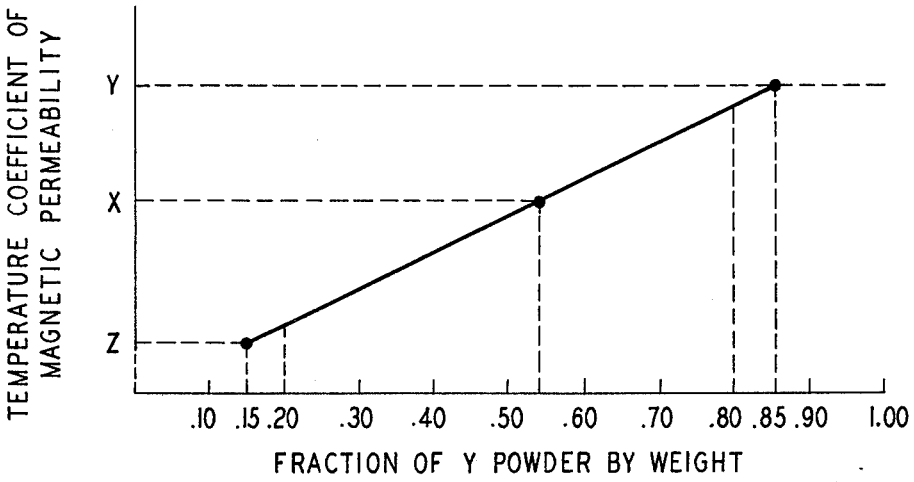
FIG. 1 is a curve showing the temperature coefficient of magnetic permeability (ordinate) of magnetic bodies produced from mixed carbonyl iron containing, powders as a function of the fraction of one of the constituent powders (abscissa)

In this formula, $X$, is the desired temperature coefficient, $Y$ and $Z$, are the temperature coefficients of test bodies produced from each of the two selected source batches and $A$ is the decimal fraction representing the desired proportion by weight of the $Y$ powder (the fraction of $Z$ powder being $(1-A)$). The curve described by this formula is illustrated in FIG. 1. If a source powder is found to produce bodies of the desired temperature coefficient that powder will be used in unmixed form.

In many cases, allowable tolerances on the product will allow the use of pure powders where such use would result in only a moderate deviation of the temperature coefficient of the produced materials from that desired. Thus, a preferred range of the parameter, A, for application of the formula of Equation 1 is from 0.2 to 0.8 (See FIG. 1). In conducted experiments, use of the above formula eliminated the need for a trial-and-error set of test cores and produced results of sufficient accuracy where simple linear interpolation would not.

While useful for all powders within the above disclosed composition range, best practice (considering such factors as homogeneity of the finished product) would dictate the use of source batches whose compositions (by weight) does not vary by more than a ratio of 2:1 in each of their constituents.

EXAMPLES

Carbonyl iron powders from five lots were obtained from two suppliers. Source batches were prepared from these powders, for pressing into toroidal transformer cores by the following process:

1. Carbonyl iron powder was placed in a mixing vessel together with a solution of phosphoric acid in acetone and stirred until the chemical reaction proceeded essentially to completion. Sufficient phosphoric acid was used to produce an insulating coating of iron phosphate on the powder grains, amounting to approximately 4 percent by weight of the dried insulated powder.

2. The dried insulated powder was mixed with a solution of a polymeric phenolic resin in acetone, the solution being approximately 50 weight percent resin. The resultant slurry was dried to form a cake containing approximately 4 percent by weight of resin.
3. The cake was ground to powder in a hammer mill.
4. The powder was screened to yield a powder of grain size from approximately 100 to 200 micrometers.
5. Approximately 0.5 weight percent of an olefin wax of melting point approximately 120°–150°C was added to the screened powder by mixing the wax in as a powder.

Toroidal cores were pressed, using powders from each batch, at a pressure of approximately 30 tons per square inch. The pressed cores were heat treated at approximately 180°C for 20 minutes to set the binder and then painted with an alkyd enamel paint. Density measurements showed approximately 10 to 15 percent void space in the cores.

These cores were tested for magnetic permeability and loss between −40°C and 80°C. They exhibited a variation of magnetic permeability which was linear to within ± 15 parts per million (PPM) per centigrade degree. The observed temperature coefficients for these cores appears in Table 1.

TABLE 1

| Source Batch | Raw Material Lot | Supplier | Temperature Coefficient |
|---|---|---|---|
| 1 | 1 | A | 26 PPM/°C |
| 2 | 2 | A | 19 |
| 3 | 2 | A | 27 |
| 4 | 2 | A | 21 |
| 5 | 3 | B | 172 |
| 6 | 4 | B | 106 |
| 7 | 4 | B | 102 |
| 8 | 5 | B | 119 |
| 9 | 5 | B | 133 |
| 10 | 5 | B | 174 |
| 11 | 2 | A | 31 |
| 12 | 4 | B | 174 |

Figure 3:
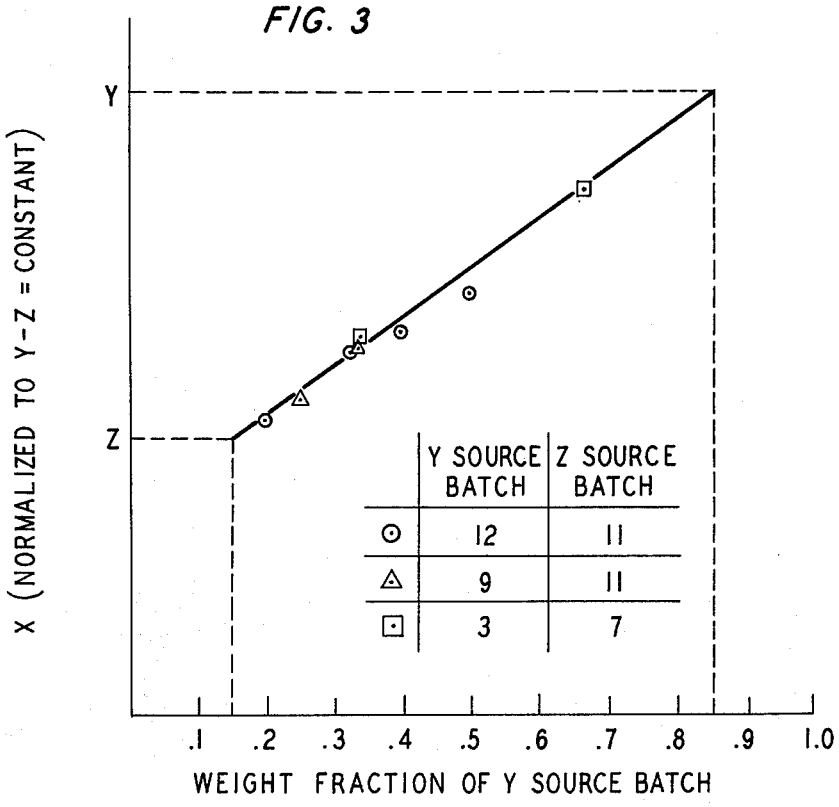
FIG. 3 is a curve of temperature coefficient (ordinate) as a function of the fraction of the higher coefficient powder (abscissa), showing normalized data points.

Cores were fabricated from mixtures of powders from source batches 3, 7, 9, 11, and 12 with proportions in accordance with Equation 1. The measured results are contained in FIG. 3, in which the vertical scale is normalized to a 100 parts per million per centigrade degree difference of temperature coefficient between bodies produced from each of the two powders of each mixed pair. The horizontal axis represents the fractional part of the higher coefficient powder.

Cores were made by mixing 120 lbs of powder from source batch 11 and 80 lbs of powder from sourch batch 12. These cores exhibited a temperature coefficient of 76 parts per million per centigrade degree. These cores were used to produce resonant filter circuits at a frequency 1.544 Mhz ± 0.0015 Mhz over a temperature range from −40°C to 80°C. The cores had a Q in excess of 175 throughout the same temperature range.

What is claimed is:

1. Method for the production of a ferromagnetic body exhibiting a predetermined temperature coefficient of magnetic permeability of value X, comprising:

a. compressing a quantity of a first particulate matter including at least 50 percent by weight of carbonyl iron powder, from 0.05 to 25 percent by weight of an insulator and from 1 to 25 percent by weight of an organic binder, to produce a first test body:

b. compressing a quantity of a second particulate matter including at least 50 percent by weight of carbonyl iron powder, from 0.05 to 25 percent by weight of an insulator and from 1 to 25 percent by weight of an organic binder, to produce a second test body;

c. measuring the value, Y, of the temperature coefficient of magnetic permeability of the first test body;

d. measuring the value, Z, of the temperature coefficient of magnetic permeability of the second test body, which said values, Y and Z, bracket the value, X;

e. mixing a first fractional portion by weight, A, of the first particulate matter with a second fractional portion, $(1-A)$, of the second particulate matter, wherein $A$ is selected in accordance with the formula:

$$A = 0.7\ [(X-Y)/(Z-Y)] + 0.15;$$

where $A$ is from 0.15 to 0.85; and f. compressing a quantity of the mixed powder to produce the ferromagnetic body of temperature coefficient of magnetic permeability, X.

2. Method of claim 1 in which A is from 0.2 to 0.8.

3. Method of claim 1 in which the first particulate matter and the second particulate matter include from 0.1 to 5 percent by weight of a lubricant, based on the total weight of the other constituents.

4. Method of claim 1 in which the insulator is essentially iron phosphate.

5. Method of claim 4 in which the iron phosphate is produced by reacting the carbonyl iron powder with a solution of phosphoric acid in an organic solvent.

6. Method of claim 4 in which the organic binder is at least one member selected from the class of phenolic or epoxy thermosetting resins.

7. Method of claim 6 in which the organic binder is applied by mixing the insulated carbonyl iron powders with a solution of the organic binder in an organic solvent and evaporating the organic solvent from the resulting slurry.

8. Method of claim 7 in which the particulate matter includes at least 2 percent by weight of organic binder.

* * * * *